US012773647B2

(12) United States Patent
Holz

(10) Patent No.: US 12,773,647 B2
(45) Date of Patent: Oct. 27, 2026

(54) SET OF TOY BUILDING BLOCKS

(71) Applicant: Florian Holz, Willich (DE)

(72) Inventor: Florian Holz, Willich (DE)

( * ) Notice: Subject to any disclaimer, the term of this patent is extended or adjusted under 35 U.S.C. 154(b) by 190 days.

(21) Appl. No.: 18/749,195

(22) Filed: Jun. 20, 2024

(65) Prior Publication Data

US 2024/0416254 A1 Dec. 19, 2024

Related U.S. Application Data

(63) Continuation of application No. PCT/EP2022/087606, filed on Dec. 22, 2022.

(30) Foreign Application Priority Data

Dec. 23, 2021 (DE) ..... 102021134579.0

(51) Int. Cl.
*A63H 33/08* (2006.01)

(52) U.S. Cl.
CPC ..... *A63H 33/086* (2013.01)

(58) Field of Classification Search
CPC ..... A63H 33/04; A63H 33/086
USPC ..... 446/85, 118, 124, 128
See application file for complete search history.

(56) References Cited

U.S. PATENT DOCUMENTS 2,611,193 A * 9/1952 Davis ..... G09B 19/02 434/196
3,233,358 A * 2/1966 Dehm ..... A63H 33/042 446/128
3,487,579 A * 1/1970 Brettingen ..... A63H 33/086 446/128
3,570,170 A * 3/1971 Kishi ..... A63H 33/086 446/128
3,597,875 A * 8/1971 Christiansen ..... A63H 33/086 446/128
4,183,167 A * 1/1980 Jatich ..... A63F 9/06 446/118
4,964,833 A * 10/1990 Suzuki ..... A63H 33/086 446/128

(Continued)

FOREIGN PATENT DOCUMENTS

DE 60116891 T2 10/2006
DE 202021107062 U1 * 3/2023 ..... A63H 33/086

(Continued)

*Primary Examiner* — Alexander R Niconovich
(74) *Attorney, Agent, or Firm* — Von Rohrscheidt Patents

(57) ABSTRACT

A building block toy set, including building blocks, including a multisided flat base plate including a base plate bottom side and a base plate top side, side walls connected at edges of the base plate bottom side at an angle of 90 degrees, cylindrical primary protrusions arranged at the base plate top side; cylindrical secondary protrusion arranged at the base plate bottom side at a uniform distance from insides of the side walls, so that the primary protrusions are insertable and clampable between the secondary protrusions and the insides of the side walls, wherein the multi sided flat base plate is an equilateral hexagonal base plate, wherein six respective primary protrusions are arranged at the base plate top side centrally with respect to side edges of the equilateral hexagonal base plate at a uniform distance from the side edges of the equilateral hexagonal base plate.

3 Claims, 2 Drawing Sheets

(56) References Cited

U.S. PATENT DOCUMENTS

| | | | | | |
|---|---|---|---|---|---|
| 4,964,834 | A * | 10/1990 | Myller | A63H 33/086 446/128 |
| 5,057,049 | A * | 10/1991 | Kaczperski | A63H 33/086 446/124 |
| 5,661,941 | A * | 9/1997 | Vataker | A63H 33/086 446/124 |
| 10,130,894 | B2 * | 11/2018 | Peiler | A63H 33/086 |
| 10,859,274 | B2 * | 12/2020 | Bordin | F24D 3/142 |
| 10,994,218 | B2 * | 5/2021 | Kogure | A63H 33/062 |
| 11,338,216 | B2 * | 5/2022 | Kogure | A63H 33/04 |
| 2021/0129039 | A1 * | 5/2021 | Movsesian | A63H 33/086 |
| 2026/0021423 | A1 * | 1/2026 | Lian | A63H 33/086 |

FOREIGN PATENT DOCUMENTS

| | | | | |
|---|---|---|---|---|
| EP | 0027840 | A1 * | 5/1981 | A63H 33/086 |
| FR | 2979251 | A1 | 3/2013 | |
| WO | WO-0236229 | A1 * | 5/2002 | A63H 33/086 |

* cited by examiner

SET OF TOY BUILDING BLOCKS

RELATED APPLICATIONS

This application is a continuation of International patent application PCT/EP2022/087606 filed on Dec. 22, 2022 claiming priority from German patent application DE 10 2021 134 579.0 filed on Dec. 23, 2021, both of which are incorporated in their entirety by this reference.

FIELD OF THE INVENTION

The invention relates to a building block toy set.

BACKGROUND OF THE INVENTION

A generic building block toy set is known under the trademark LEGO and described in U.S. Pat. No. 3,005,282.

In the known building block toy set the base plate has a rectangular cross section which provides a plethora of building options while still limiting the number of variations.

EP 0027840 discloses building blocks for pyramids, spacecraft, figurines, spheres, honeycombs, futuristic objects, and other objects that are difficult to represent. The building blocks include a hexagonal base plate including six primary protrusions and six secondary protrusions. In order to connect the building blocks with one another the secondary protrusions are arranged so that the primary protrusions precisely fit between the secondary protrusions and an outer side achieving a clamping effect.

Another system of building blocks is known from DE 601 16 891 T2. A base element of the system is configured as an equilateral octagon and includes at least four coupling protrusion at a top side wherein two coupling protrusions are arranged as central protrusions on a first circle and two coupling protrusions are arranged as circumference protrusions on a second larger circle. The base element includes stiffening ribs on a bottom side, wherein the stiffening ribs are in contact with walls of the base element and with a cylindrical connection wall. Two building blocks are connected with one another through a contact of the coupling protrusions with the stiffening ribs and/or the connection wall and/or the walls.

BRIEF SUMMARY OF THE INVENTION

Thus, it is the object of the invention to provide a novel building block toy set that is improved over the known building block toy set and that includes individual building blocks that differ from a rectangular shape.

The object is achieved by a building block toy set including building blocks, including a multisided flat base plate including a base plate bottom side and a base plate top side, side walls connected at edges of the base plate bottom side at an angle of 90 degrees, cylindrical primary protrusions arranged at the base plate top side; cylindrical secondary protrusion arranged at the base plate bottom side at a uniform distance from insides of the side walls, so that the primary protrusions are insertable and clampable between the secondary protrusions and the insides of the side walls, wherein the multi sided flat base plate is an equilateral hexagonal base plate, wherein six respective primary protrusions are arranged at the base plate top side centrally with respect to side edges of the equilateral hexagonal base plate at a uniform distance from the side edges of the equilateral hexagonal base plate, wherein six respective secondary protrusions are arranged at the base plate bottom side opposite to corner points of the equilateral hexagonal base plate at a uniform distance; and additional building blocks that are created by symmetrical axial central dividing of the equilateral hexagonal base plate between adjacent primary protrusions and secondary protrusions, wherein a stiffening ring is arranged at the base plate bottom side in contact with insides of the cylindrical secondary protrusions.

The core of the invention is to apply a stiffening ring to a bottom of the plate wherein the stiffening ring contacts insides of the cylindrical secondary protrusions.

A hexagonal base plate is used as a basic shape for a building block and additional building blocks are provided which are created by symmetrical axial dividing of the hexagonal base plate centrally between adjacent primary and secondary protrusions.

Advantageous embodiments of the additional building blocks are described in the dependent claims.

According to an advantageous embodiment of the invention the additional building blocks include building blocks that are created by central dividing between opposite corner points of the hexagonal base plate.

According to another advantageous embodiment of the invention, the additional building blocks include building blocks created by pie shaped symmetrical dividing of an equilateral hexagonal base plate into six partial components.

Advantageously the additional building blocks include building blocks which are created by symmetrically dividing the equilateral hexagonal base plate into three partial components respectively including two primary protrusions and two secondary protrusions.

The additional building blocks advantageously include building blocks which include a unit of at least two partial components arranged at one another. According to another advantageous embodiment of the invention, the additional building blocks can include building blocks that are assembled into a unit from an equilateral hexagonal building block and a building block created by centrally dividing the equilateral hexagonal building block into two partial components between opposite corner points of the equilateral hexagonal building block.

The building block toy set according to the invention advantageously includes a base board that is provided with primary pins arranged in a hexagonal configuration on a top side of the base board.

Advantageously a secondary protrusion can be centrally arranged at a bottom side of the plate wherein the secondary protrusion has an inner diameter that fits into an outer diameter of the primary protrusion so that the secondary protrusion can be plugged onto the primary protrusion.

BRIEF DESCRIPTION OF THE DRAWINGS

The invention is subsequently described with reference to the drawing figures, wherein.

DETAILED DESCRIPTION OF THE INVENTION

Figure 1:
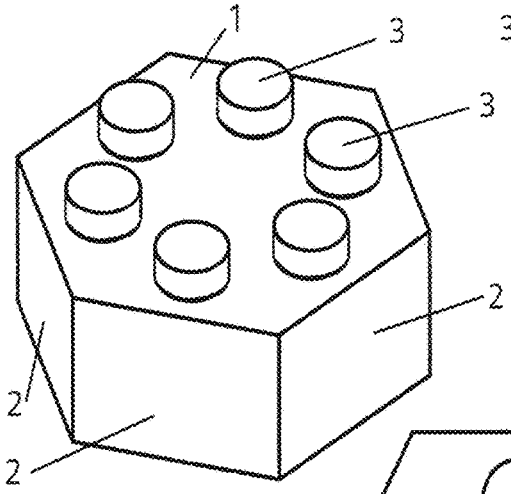
FIG. 1 illustrates an enlarged isometric view of a building block according to the invention.
Figure 2:
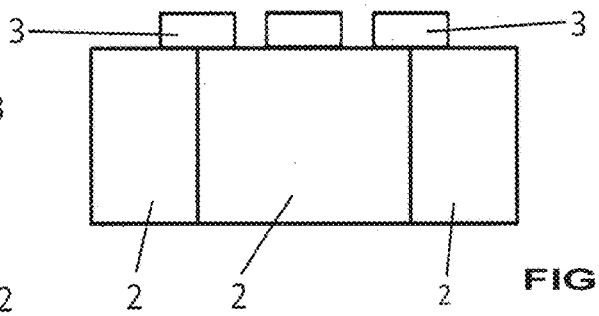
FIG. 2 illustrates a side view of the building block.
Figure 3:
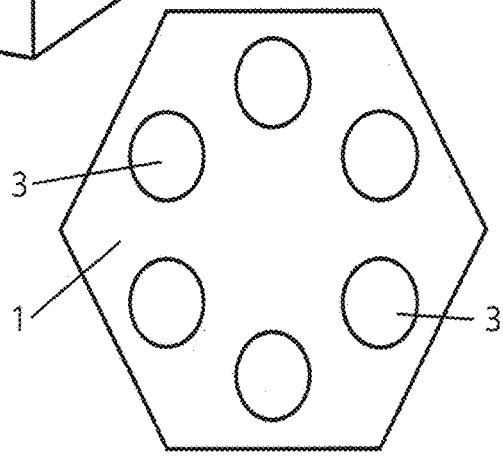
FIG. 3 illustrates a top view of the building block according to the invention.

The basic shape of the building block according to the invention is an equilateral hexagonal base plate 1 with a base plate top side including six cylindrical primary protrusions 3 as shown in FIG. 1 in a perspective view, in FIG. 2 in a side view and in FIG. 3 in a top view.

The primary protrusions 3 are arranged centrally with respect to the side edges of the equilateral hexagonal base plate and at a distance therefrom.

Side walls 2 are formed at a base plate bottom side of the base plate 1.

Figure 4:
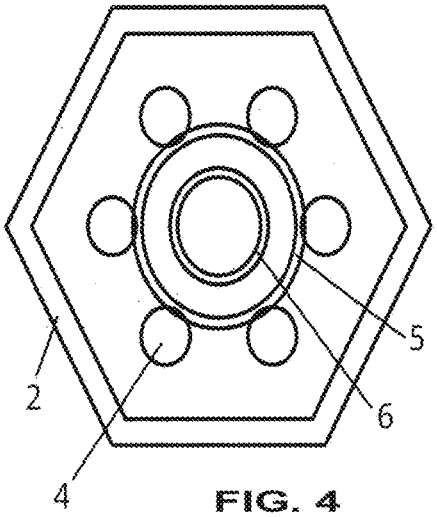
FIG. 4 illustrates a bottom view of the building block according to the invention.

As shown in FIG. 4, six cylindrical secondary protrusions 4 are arranged at the base plate bottom side of the hexagonal base plate and respectively oriented towards corner points of the hexagonal base plate and arranged at a distance from the side walls 2.

The cylindrical secondary protrusions 4 are arranged at a distance from the insides of the side walls 2 so that the cylindrical primary protrusions 3 can be inserted and clamped between the cylindrical secondary protrusions 4 and side walls 2.

As shown in FIG. 4 a cylindrical stiffening ring 5 is arranged at a bottom side of the base plate 1 and in direct contact with outer enveloping surfaces of the six cylindrical secondary protrusions 4.

Figure 5:
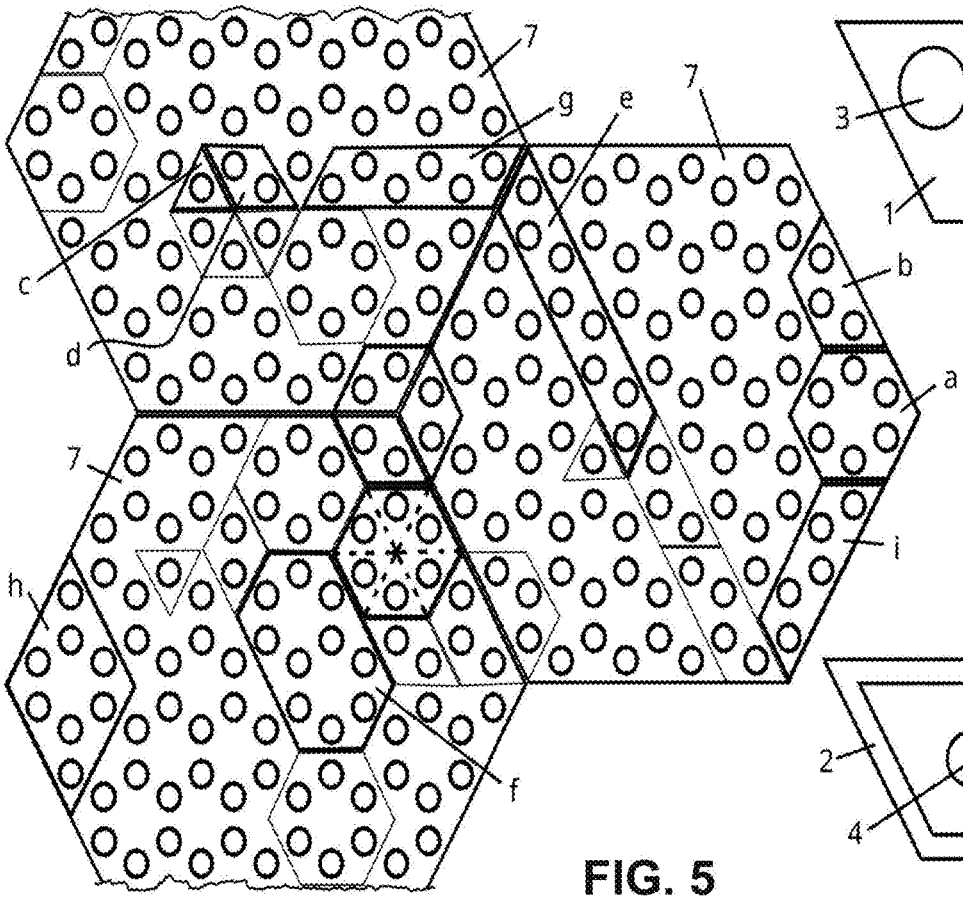
FIG. 5 illustrates a top view of three building block base boards joined adjacent to one another and including plural additional building block elements drawn in thick lines.

FIG. 5 illustrates three equilateral hexagonal base boards 7 connected with one another by a hexagonal building block and forming a base board arrangement for plugging on the building blocks according to the invention. FIG. 5 illustrates several embodiments of the additional building blocks a, b, c, d, e, f, g, h and i drawn in bold lines on the equilateral hexagonal base boards 7. The additional building blocks c and d are pluggable onto a base board according to U.S. Pat. No. 3,005,282 used by the building block toy set sold under the trademark LEGO.

Figure 6:
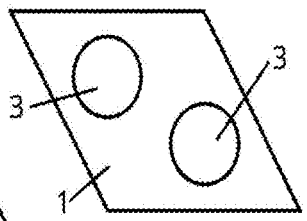
FIG. 6 illustrates a top view of another building block element.
Figure 7:
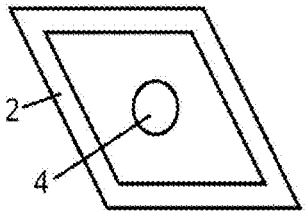
FIG. 7 illustrates a bottom view of the building block element illustrated in FIG. 6.

FIG. 6 illustrates a top view of the additional building block d of FIG. 5 and FIG. 7 illustrates a bottom view of the additional building block d of FIG. 5.

When the dimensions of the building blocks, in particular dimensions of the primary and the secondary protrusions are selected accordingly the building block set according to the invention can be used together with building blocks from other manufacturers, e.g. the manufacturer of U.S. Pat. No. 3,005,282.

The primary protrusions 3 can have a diameter of 4.8 mm and an axis offset of 8 mm from one another.

The inner diameter of the secondary protrusion 6 is fitted to the diameter of primary protrusion 3 in order to receive the primary protrusion 3.

As a total height for a building block 11.4 mm are proposed and a height of the primary protrusions 3 of 1.8 mm is proposed. However, the heights are scalable and other heights may be used.

The building blocks and the base plates are advantageously made from a slightly elastic and deformable synthetic material, e.g. on EPS or EPE basis.

What is claimed is:

1. A building block toy set, comprising:

hexagonal building blocks, including a multisided flat base plate including a base plate bottom side and a base plate top side, side walls connected at edges of the base plate bottom side at an angle of 90 degrees, cylindrical primary protrusions arranged at the base plate top side; and cylindrical secondary protrusion arranged at the base plate bottom side at a uniform distance from insides of the side walls, so that the cylindrical primary protrusions are insertable and clampable between the cylindrical secondary protrusions and the insides of the side walls, and an outer diameter of the cylindrical primary protrusions is greater than an outer diameter of the cylindrical secondary protrusions, wherein the multisided flat base plate is an equilateral hexagonal base plate including a center axis extending through a center of the hexagonal base plate and orthogonal to the base plate top side, wherein six respective cylindrical primary protrusions are arranged at the base plate top side centrally with respect to side edges of the equilateral hexagonal base plate at a uniform distance from the side edges of the equilateral hexagonal base plate, wherein six respective cylindrical secondary protrusions are arranged at the base plate bottom side opposite to corner points of the equilateral hexagonal base plate at a uniform distance, wherein a cylindrical stiffening ring is arranged at the base plate bottom side in contact with outer enveloping surfaces of the six cylindrical secondary protrusions, wherein the cylindrical secondary protrusions are directly radially supported exclusively by the cylindrical stiffening ring and by the hexagonal base plate.

2. The building block toy set according to claim 1, wherein an additional cylindrical secondary protrusion is centrally arranged at the base plate bottom side, wherein an inner diameter of the additional cylindrical secondary protrusion corresponds to has an outer diameter of the cylindrical primary protrusions so that the additional cylindrical secondary protrusion is pluggable onto one of the cylindrical primary protrusions.

3. A building block toy set, comprising: at least one base board for plugging on the building blocks according to claim 1, wherein the base board includes primary pins arranged on a base board top side in a hexagonal configuration.

* * * * *